US005208422A

United States Patent [19]

Moody

[11] Patent Number: 5,208,422

[45] Date of Patent: May 4, 1993

[54] SUBMARINE WEAPON LAUNCH CONTROL SYSTEM

[75] Inventor: Paul E. Moody, Barrington, R.I.

[73] Assignee: The United States of America as represented by the Secretary of the Navy, Washington, D.C.

[21] Appl. No.: 904,630

[22] Filed: Jun. 26, 1992

[51] Int. Cl.[5] ..... F41F 3/10

[52] U.S. Cl. ..... 89/1.809; 114/238

[58] Field of Search ..... 114/238, 316; 89/1.809, 89/1.56, 1.8, 1.11

[56] References Cited

U.S. PATENT DOCUMENTS

| | | | |
|---|---|---|---|
| 3,598,015 | 8/1971 | Delistovich et al. | 89/1.56 |
| 3,779,129 | 12/1973 | Lauro | 89/1.814 |
| 4,825,151 | 4/1989 | Aspelin | 89/1.56 |
| 5,099,745 | 3/1992 | Hubbell et al. | 114/238 |

*Primary Examiner*—David H. Brown

*Attorney, Agent, or Firm*—Michael J. McGowan; Prithyi C. Lall; Michael F. Oglo

[57] ABSTRACT

A submarine torpedo launching and control assembly has a multiplicity of torpedo tubes each having muzzle and breech doors and a series of fluid operated mechanisms for operation of various elements and actuator valves for operating these mechanisms. A source of fluid under pressure and conduits therefrom to said actuator valves for operating said fluid operated mechanisms. A control panel has a series of manipulatable fluid control members associated with the actuator valves for operating the fluid operated mechanisms, and these members are movable from a first position to a second position to effect the direction of flow of fluid to and from the actuator valves and thereby to move the mechanisms between the first and second positions. Visual indicators indicate the position of the associated fluid control members and thereby that of the fluid operated mechanisms. At least two interlock valves interlock fluid operated mechanisms and require fluid to flow through them to permit operation of mechanisms subsequent thereto in the fluid path defined by the conduits if the interlocked mechanism effecting its actuation has not been moved to its second position.

17 Claims, 9 Drawing Sheets

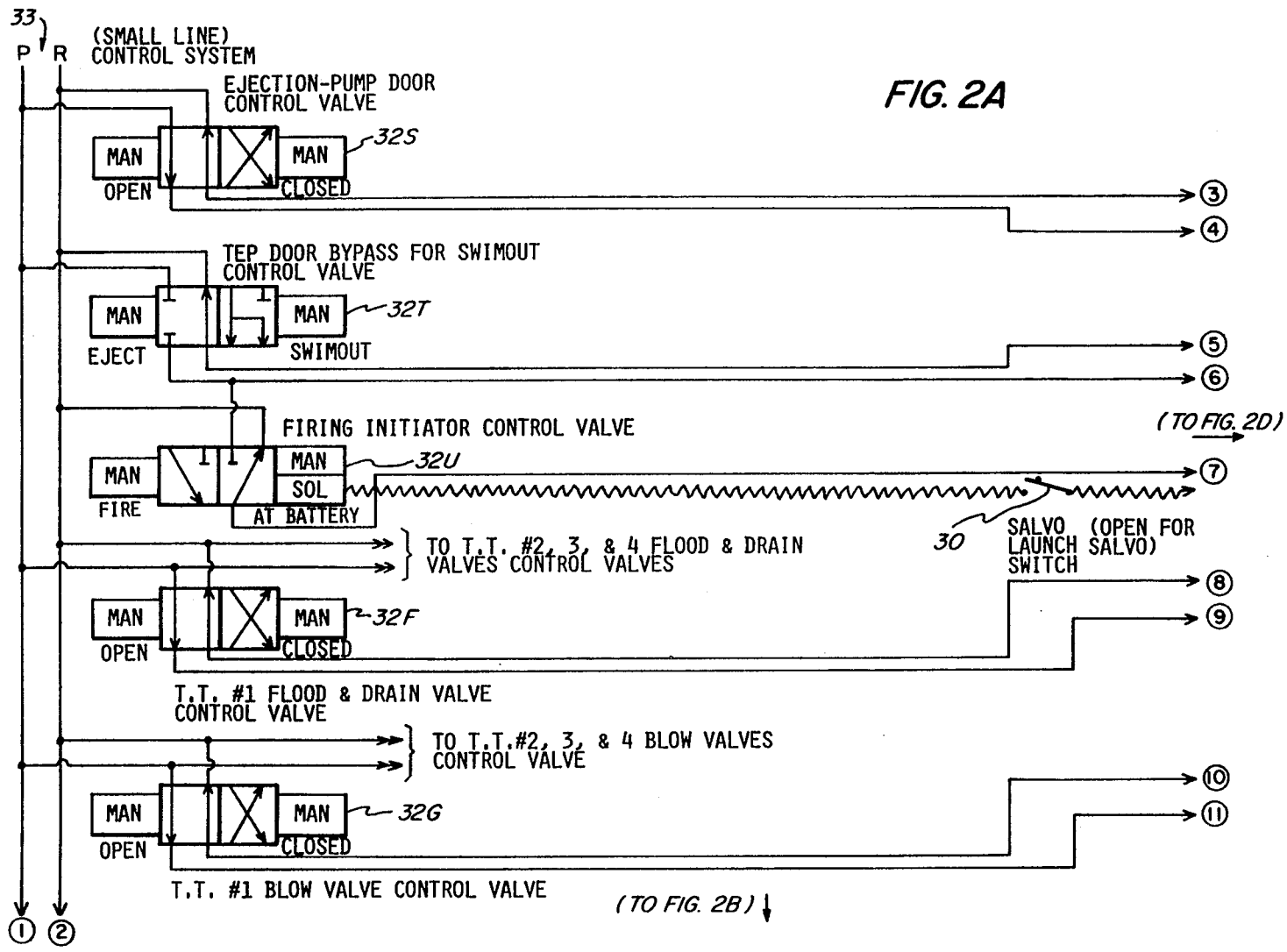
FIG. 2A
(SMALL LINE) CONTROL SYSTEM
EJECTION-PUMP DOOR CONTROL VALVE
32S
MAN
CLOSED
MAN
OPEN
TEP DOOR BYPASS FOR SWIMOUT CONTROL VALVE
32T
MAN
SWIMOUT
MAN
EJECT
FIRING INITIATOR CONTROL VALVE
32U
MAN
SOL
AT BATTERY
MAN
FIRE
(TO FIG. 2D)
SALVO LAUNCH SWITCH (OPEN FOR SALVO)
30
TO T.T. #2, 3, & 4 FLOOD & DRAIN VALVES CONTROL VALVES
32F
MAN
CLOSED
MAN
OPEN
T.T. #1 FLOOD & DRAIN VALVE CONTROL VALVE
TO T.T. #2, 3, & 4 BLOW VALVES CONTROL VALVE
32G
MAN
CLOSED
MAN
OPEN
T.T. #1 BLOW VALVE CONTROL VALVE
(TO FIG. 2B)
33
P
R
1
2
3
4
5
6
7
8
9
10
11

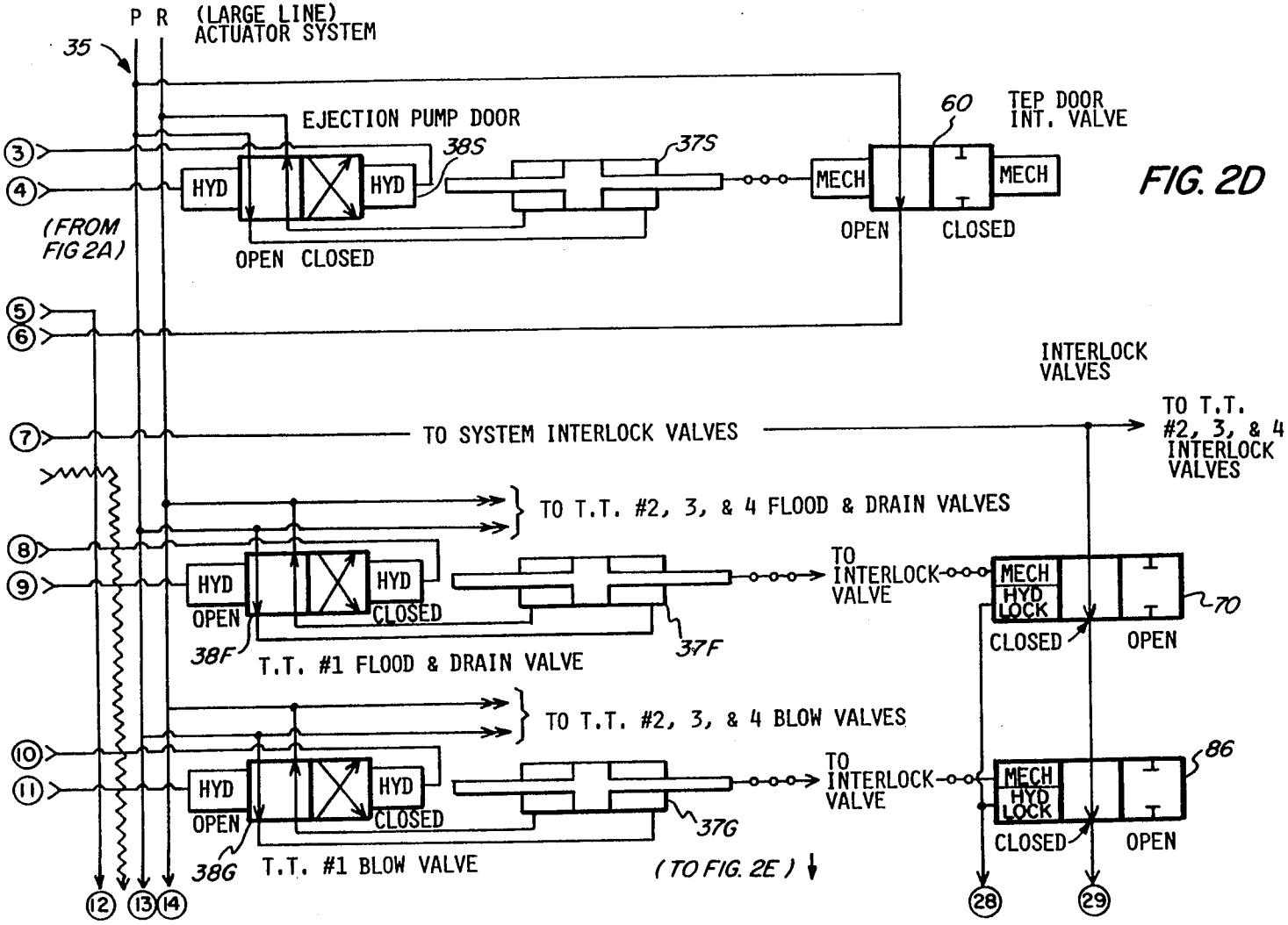
FIG. 2D
TEP DOOR INT. VALVE
MECH
60
CLOSED
OPEN
MECH
37S
EJECTION PUMP DOOR
38S
HYD
OPEN CLOSED
HYD
(LARGE LINE) ACTUATOR SYSTEM
P R
35
(FROM FIG 2A)
INTERLOCK VALVES
TO T.T. #2, 3, & 4 INTERLOCK VALVES
TO SYSTEM INTERLOCK VALVES
70
OPEN
MECH
HYD LOCK
CLOSED
TO INTERLOCK VALVE
TO T.T. #2, 3, & 4 FLOOD & DRAIN VALVES
37F
HYD
CLOSED
HYD
OPEN
38F
T.T. #1 FLOOD & DRAIN VALVE
86
OPEN
MECH
HYD LOCK
CLOSED
TO INTERLOCK VALVE
TO T.T. #2, 3, & 4 BLOW VALVES
37G
HYD
CLOSED
HYD
OPEN
38G
T.T. #1 BLOW VALVE
(TO FIG. 2E)
29
28
14
13
12
3
4
5
6
7
8
9
10
11

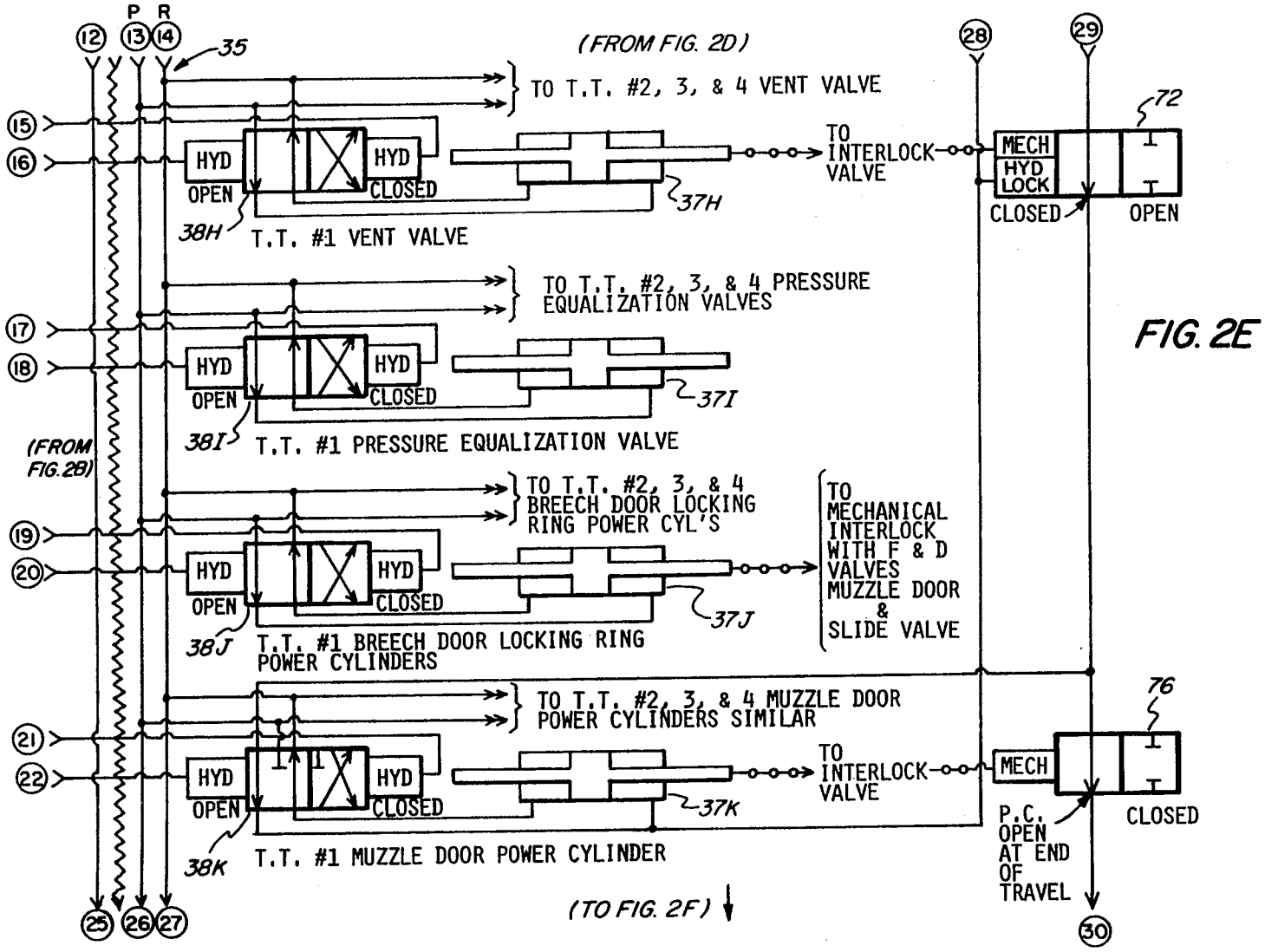
FIG. 2E
(FROM FIG. 2D)
TO T.T. #2, 3, & 4 VENT VALVE
TO INTERLOCK VALVE
MECH
HYD LOCK
CLOSED
OPEN
72
76
MECH
P.C. OPEN AT END OF TRAVEL
TO T.T. #2, 3, & 4 PRESSURE EQUALIZATION VALVES
TO MECHANICAL INTERLOCK WITH F & D VALVES MUZZLE DOOR & SLIDE VALVE
TO T.T. #2, 3, & 4 BREECH DOOR LOCKING RING POWER CYL'S
TO T.T. #2, 3, & 4 POWER CYLINDERS MUZZLE DOOR SIMILAR
37H
37I
37J
37K
HYD
CLOSED
OPEN
38H
38I
38J
38K
T.T. #1 VENT VALVE
T.T. #1 PRESSURE EQUALIZATION VALVE
T.T. #1 BREECH DOOR LOCKING RING POWER CYLINDERS
T.T. #1 MUZZLE DOOR POWER CYLINDER
(TO FIG. 2F)
(FROM FIG. 2B)
P R
35
12
13
14
15
16
17
18
19
20
21
22
25
26
27
28
29
30

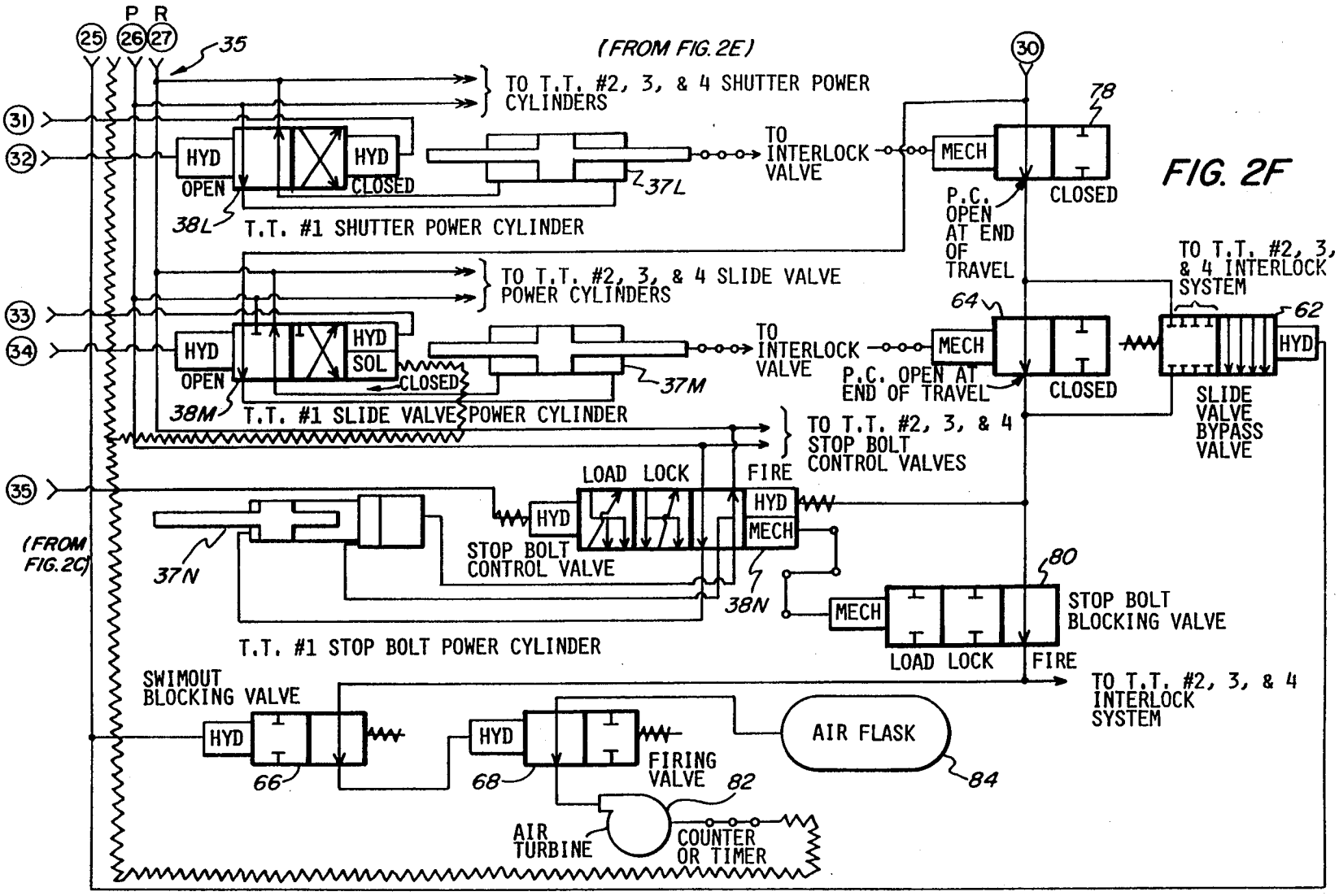
FIG. 2F
(FROM FIG. 2E)
TO T.T. #2, 3, & 4 SHUTTER POWER CYLINDERS
TO INTERLOCK VALVE
T.T. #1 SHUTTER POWER CYLINDER
TO T.T. #2, 3, & 4 SLIDE VALVE POWER CYLINDERS
T.T. #1 SLIDE VALVE POWER CYLINDER
TO T.T. #2, 3, & 4 INTERLOCK SYSTEM
SLIDE VALVE BYPASS VALVE
P.C. OPEN AT END OF TRAVEL
TO T.T. #2, 3, & 4 STOP BOLT CONTROL VALVES
STOP BOLT CONTROL VALVE
LOAD LOCK
FIRE
STOP BOLT BLOCKING VALVE
TO T.T. #2, 3, & 4 INTERLOCK SYSTEM
T.T. #1 STOP BOLT POWER CYLINDER
SWIMOUT BLOCKING VALVE
AIR FLASK
FIRING VALVE
COUNTER OR TIMER
AIR TURBINE
(FROM FIG. 2C)
HYD
MECH
SOL
OPEN
CLOSED
P
R

SUBMARINE WEAPON LAUNCH CONTROL SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to torpedo launching systems, and, more particularly, to hydraulic or other pressurized fluid systems for operating the various elements of a torpedo tube assembly.

(2) Description of the Prior Art

As is well known, modern submarines generally employ torpedo tube assemblies which have a number of operational components which must be moved between positions in which the torpedo may be loaded into the tube and positions in which the torpedo may be fired from the tube. Among such components are the breech door, and muzzle door, and a shutter which fairs the submarine's outer hull. Stop bolts are employed to position and control motion of the torpedo within the torpedo tube, and valves allowing flow of water into the torpedo tube, equalization of pressure and ultimately blowing water from the tube are also employed.

Moreover, frequently it is desired not only to provide for ejection of the torpedo from the tube by means of pressurized air or other pressurized fluid but also to permit the torpedo to propel itself from the tube.

Because of the multiplicity of components which must be actuated between battery and firing positions, the control systems have become complex and manually operated valves, low pressure air valves, high pressure air valves, hydraulic control valves and solenoid valves have been employed in an effort to control the firing sequence. Because of the complexity involved in interfacing these systems, the motive fluid to operate the power cylinders which in turn actuate the components are generally located adjacent the torpedo tube and control of their operation at times may not be reliable due to failure of elements in the system, moreover, it is desirable to interlock various components to ensure that firing of the torpedo may not occur unless all elements are in the firing position.

Presently, electrical components are used in combination with pneumatic and hydraulic components to perform safety and operational functions, and failure of such components or their improper operation can jeopardize the vessel or result in inability to launch the torpedo.

SUMMARY OF THE INVENTION

It is an object of the present invention to provide a novel torpedo launching control assembly which utilizes a control panel with manually actuated switches to control the operation of actuator valves in a pressurized fluid circuit which controls the position of power cylinders utilized for movement of the various elements of the torpedo tube assembly.

It is also an object to provide such a torpedo tube assembly which primarily utilizes two position valves of relatively simple construction for the control functions and these may be relatively small valves which are manually actuated at a control panel.

Another object is to provide a manual control panel from which substantially all torpedo tube launch system functions can be controlled and which includes indicator lights to reflect the condition of the individual components of the system.

Still another object is to provide such a torpedo launching and control assembly with a series of interlocks which are highly effective to prevent firing of the torpedo unless all operational elements are in the firing position.

A further object is to provide a hydraulic control system which eliminates pneumatic control valves to simplify and reduce the manufacturing, installation and maintenance costs.

It has now been found that the foregoing and related objects and advantages can be readily attained in a submarine torpedo launching and control assembly comprising a multiplicity of torpedo tubes each having muzzle and breech doors and having a series of fluid operated mechanisms which are movable from a first position to a second position for operation of various elements of the assembly. There are also provided actuator valves for operating the mechanisms, a source of fluid under pressure, and conduits from the fluid source to the actuator valves for operating the fluid operated mechanisms.

A control panel has a series of manipulatable fluid control members each associated with one of the actuator valves to operate the fluid operated mechanisms. The control members are movable from a first position to a second position to effect the direction of flow of fluid to and from the actuator valves and thereby to move the mechanisms between their first and second positions. Visual indicators in the panel are associated with each of the fluid control members to indicate the position of the associated fluid control member and thereby the fluid operated mechanism. At least two interlock valves are provided to interlock at least two of the fluid operated mechanisms so as to require fluid to flow through the interlock valves to permit operation of mechanisms subsequent thereto in the fluid path defined by the conduits if the interlocked mechanism effecting its actuation has not been moved to its second position.

Usually, at least some of the fluid operated mechanisms include a piston/cylinder component and the piston effects the desired movement of an operating element of the assembly and the actuator valves control the flow of fluid thereto. The fluid operated mechanisms include the breech and muzzle doors, and the fluid under pressure is hydraulic fluid.

Preferably, the control members comprise a pilot valve and a manipulatable switch on the face of the panel for operating the pilot valve to control flow therethrough. Desirably, the switch is a slide switch, and the visual indicators are illuminated and bear legends. The control members for each torpedo tube are aligned in a column and are movable horizontally from their first position to the second position. The first and second positions of the control members are vertically aligned. The corresponding control members for the multiplicity of torpedo tubes are disposed in aligned rows in a multiplicity of columns.

In most installations, the mechanisms will include a firing actuator control valve, a valve for flooding the torpedo tube, a valve for equalizing pressure in the flooded tube with the pressure external to the submarine, means for opening the muzzle door, means for opening the shutter, and means for firing the torpedo. Included among the fluid operated mechanisms is also a vent valve for venting air from the tube during flooding.

Desirably, there is included an actuator for moving the fluid control member associated with the firing initiator valve from the second position to the first position upon firing of the torpedo. A salvo switch is operative to prevent the actuator from moving the firing initiator control valve to enable firing of torpedoes in the multiplicity of torpedo tubes as a salvo. Generally, the fluid operated mechanisms include a slide valve functioning to provide pressure against the aft end of the torpedo to discharge it from the torpedo tube, and a solenoid to open the valve upon receipt of a signal that the torpedo has been discharged. The slide valves of the several torpedo tubes are interlocked to permit sequential firing when the salvo switch is actuated.

Preferably, included in the fluid operated mechanisms is an ejection pump door and a ejection pump door bypass for swimout of the torpedo. Interlocking valves are provided requiring the shutter and muzzle door mechanisms to have been moved to their second position to effect firing of the torpedo.

BRIEF DESCRIPTION OF THE DRAWINGS

A more complete understanding of the invention and many of the attendant advantages thereto will be readily appreciated as the invention becomes better understood by reference to the following detailed description when considered in conjunction with the accompanying drawings wherein:

FIGS. 2A-2F are segments of the hydraulic circuit employed in the torpedo launching and control assembly operated by the control panel of FIG. 1.

DESCRIPTION OF THE PREFERRED EMBODIMENT

Figure 1:
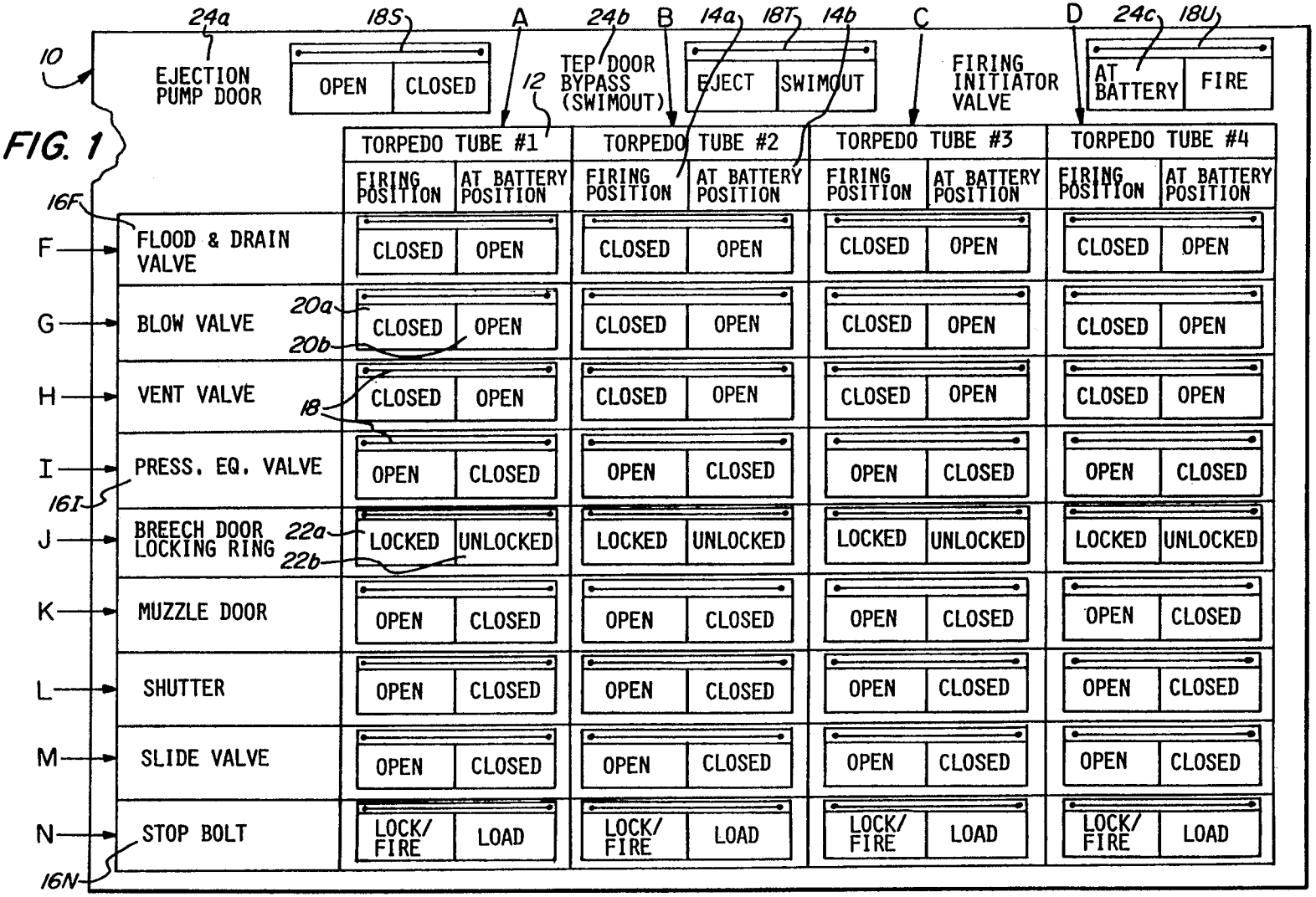
FIG. 1 is a plan view of a control panel for use in a torpedo launching and control assembly embodying the present invention.

Turning first to FIG. 1, therein illustrated is a manually operated hydraulic control panel generally designated by the numeral 10 which is utilized in the torpedo launching and control assembly of the present invention and adapted to control the operation of four torpedo tubes. Slide switches 18 for control valves are arranged in four columns designated A, B, C and D and corresponding to the individual torpedo tubes, and the switches 18 for the corresponding functions for each torpedo tube are arranged in rows designated F-N. At the top of the control panel is a header row containing three slide switches 18S, 18T, 18U. Together this collection of slide switches 18 effects control over the four separate torpedo tubes. Not shown is a salvo switch 30 (illustrated schematically in FIGS. 2A) in the fire control system which is schematically designated 43 in FIG. 3.

At the top of each of the columns A-D are a column heading 12 identifying the torpedo tube and position headings 14*a*, 14*b*. At the side of the rows F-N are row labels 16F-16N identifying the particular control for the torpedo tubes. In each row of the columns are a pair of light emitting diodes (LEDS) 20A, 20B which have imprinted thereon legends 22A, 22B to identify the status of the particular actuator being controlled by the slide switch 18 and/or the position of the mechanism which it controls. Examination of the labelling will show that, when the switches 18 of a particular column are in the right hand position, the torpedo is at the "battery" or non-firing position, and that, when the switches are in the "firing" or left hand position, the torpedo tube is set for firing.

At the top of the control panel, the three slide switches 18S, 18T and 18U are identified by the headings 24A, 24B and 24C, in a fashion similar to the identification of switches 18 by the row labels F-N. These switches also have LEDs 20A, 20B with legends 22A, 22B identifying position or status of the function which they control.

Figure 3:
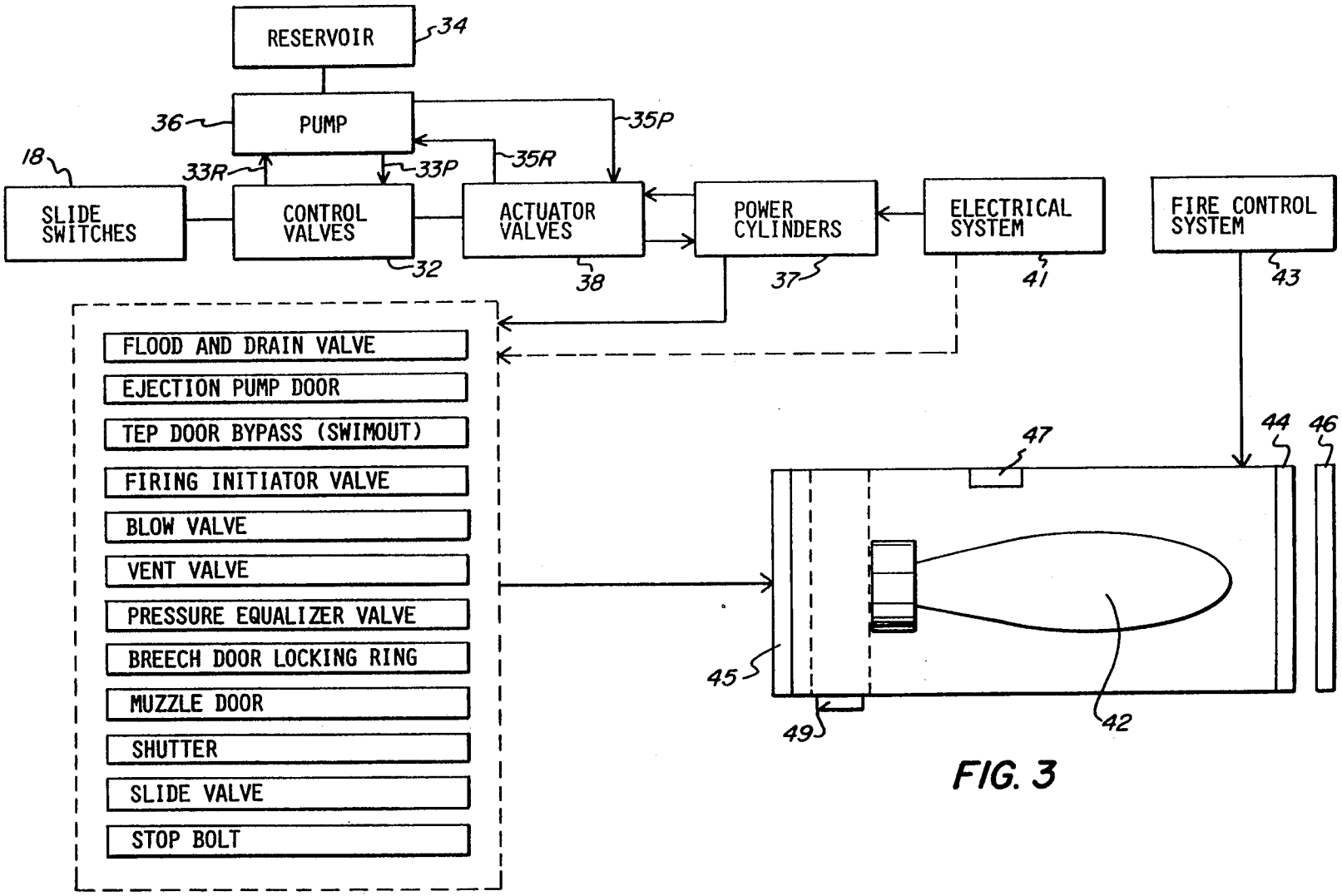
FIG. 3 is a schematic diagram of the torpedo tube launching and control assembly as combined with a diagrammatically illustrated torpedo and torpedo tube.

As seen in the schematic diagram in FIG. 3, the slide switches 18 operate control valves 32 which are in the small line flow path 33 for fluid from the reservoir 34 which is pressurized by the pump 36, and they control the direction of flow of pressurized fluid in the large line flow path 35 to the large actuator valves 38 which in turn effect the various mechanical functions for the torpedo tube 40 to discharge the torpedo 42 such as the subassemblies for opening the muzzle door 44 and shutter 46 for locking the breech door 45, for flooding or draining the tube, equalizing the pressure, venting, engaging the lock bolt 47 of the torpedo 42, and providing a high pressure stream of water on its aft end through the slide 49. As will be described hereinafter, a series of interlocks of the operating valves 38 preclude firing of the torpedo 42 unless all switches 18 are in a firing position.

Also diagrammatically illustrated in FIG. 3 are the electrical system 41 and fire control system 43 which cooperate with the fluid control system of the present invention to complete the controls for effecting torpedo launching.

Each slide switch 18 operates one of a collection of small control valves generally designated by the numeral 32 disposed behind the panel and which are disposed in the small lines 33 connected to the pump 36. These are operative to control the flow of the large lines 35 to effect reversal of the flow of pressurized fluid from the pump 36 to the associated actuator valves generally designated by the numeral 38 which control the direction of flow of fluid to the several operating mechanisms or power cylinders 37 of the torpedo tube assembly.

Figure 2:
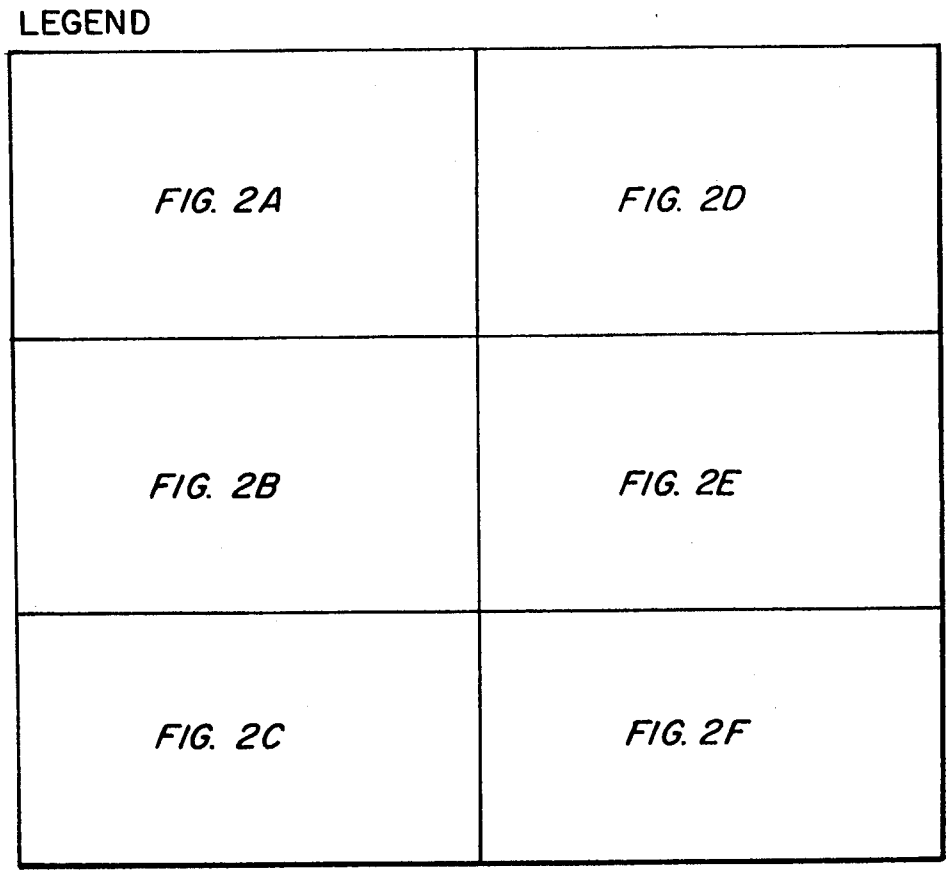
FIG. 2 is a schematic view of the layout of the hydraulic circuit segments of FIGS. 2A-2F.

Turning next to FIG. 2, this is a schematic layout showing the manner in which the hydraulic circuit segments represented by FIGS. 2A-2F are joined together to provide the complete hydraulic circuit diagram.

Turning to FIG. 2A, the left hand vertical lines designated 33P and R represent the small pressure and return lines communicating with the pump 36 and providing the control system.

In preparing for the firing of a torpedo, the operator must determine whether the torpedo 42 is to be ejected from the torpedo tube 40 by pressure or is to exit under the propulsion of its own motor ("swimout"). If the choice is to eject it by pressure, the slide switch 18S for the ejection pump door control valve 32S is moved to the left or "open" position and the slide switch 18T for the TEP door bypass control valve 32T is moved to the left or "eject" position.

As a result and as seen in FIGS. 2D and 3, flow of pressurized fluid from the pump 36 through the large lines 35P will operate the actuator valve 38S to actuate the piston 37S which is mechanically connected to the pump door (not shown) to effect its opening. This will also place the interlock valve 60 to the open position to allow fluid to flow therethrough.

If self-propulsion or swimout is selected, the ejection pump door switch 18S is retained in the "closed" position and the bypass switch 18T is maintained in the "swimout" position. In this position, the slide valve bypass valve 62 (seen in FIG. 2F) is operated to bypass the interlock valve 64 associated with the slide valve power cylinder 37M.

If the control switch 18T for the ejection pump door bypass were in the "swimout" position and the ejection pump door switch 18S were in the "open" position, pressure in the hydraulic circuit would actuate the swimout blocking valve 66 seen in FIG. 2F so that the firing valve 68 seen in FIG. 2F will not open.

Figure 2B:
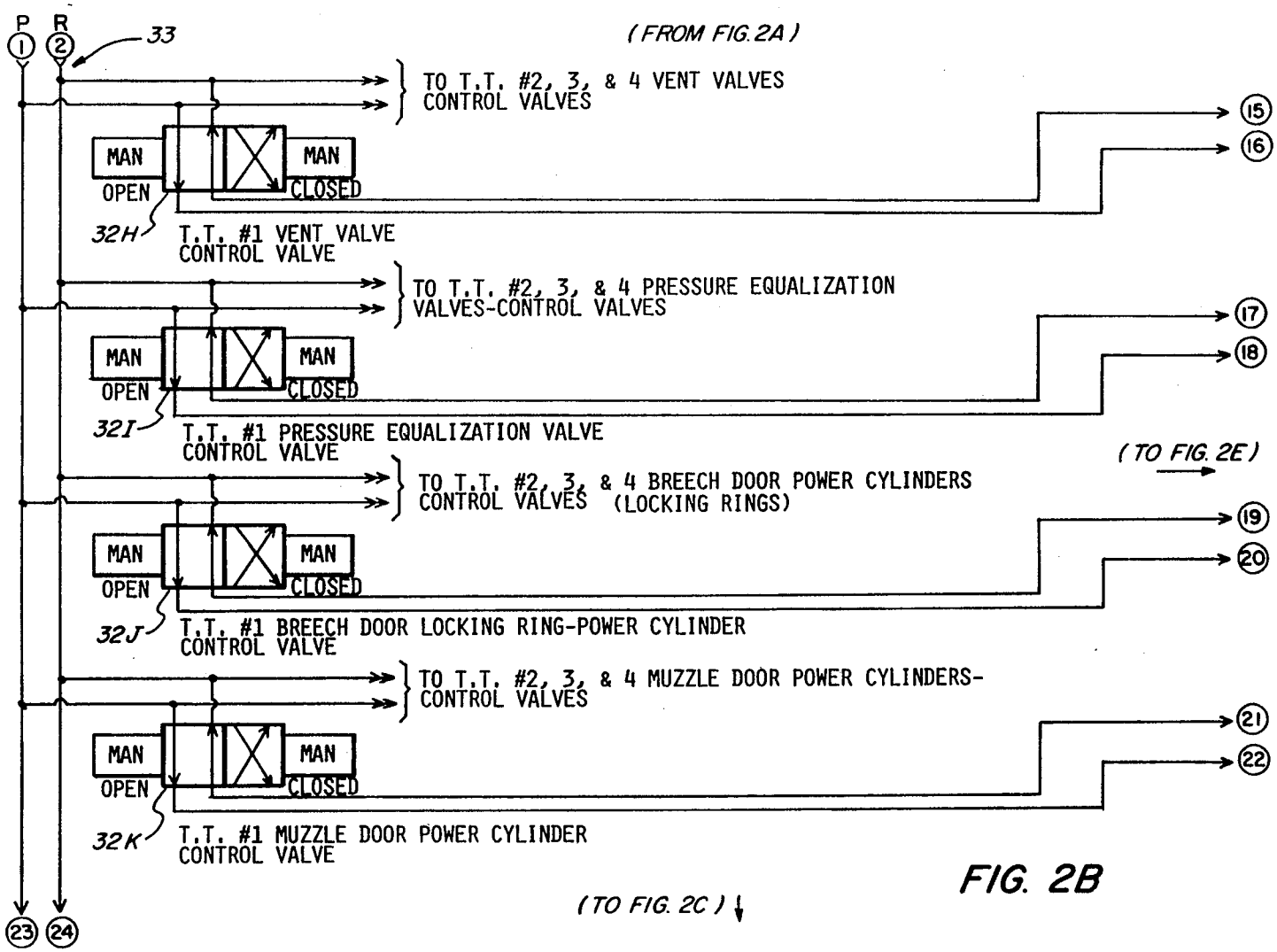
Figure 2C:
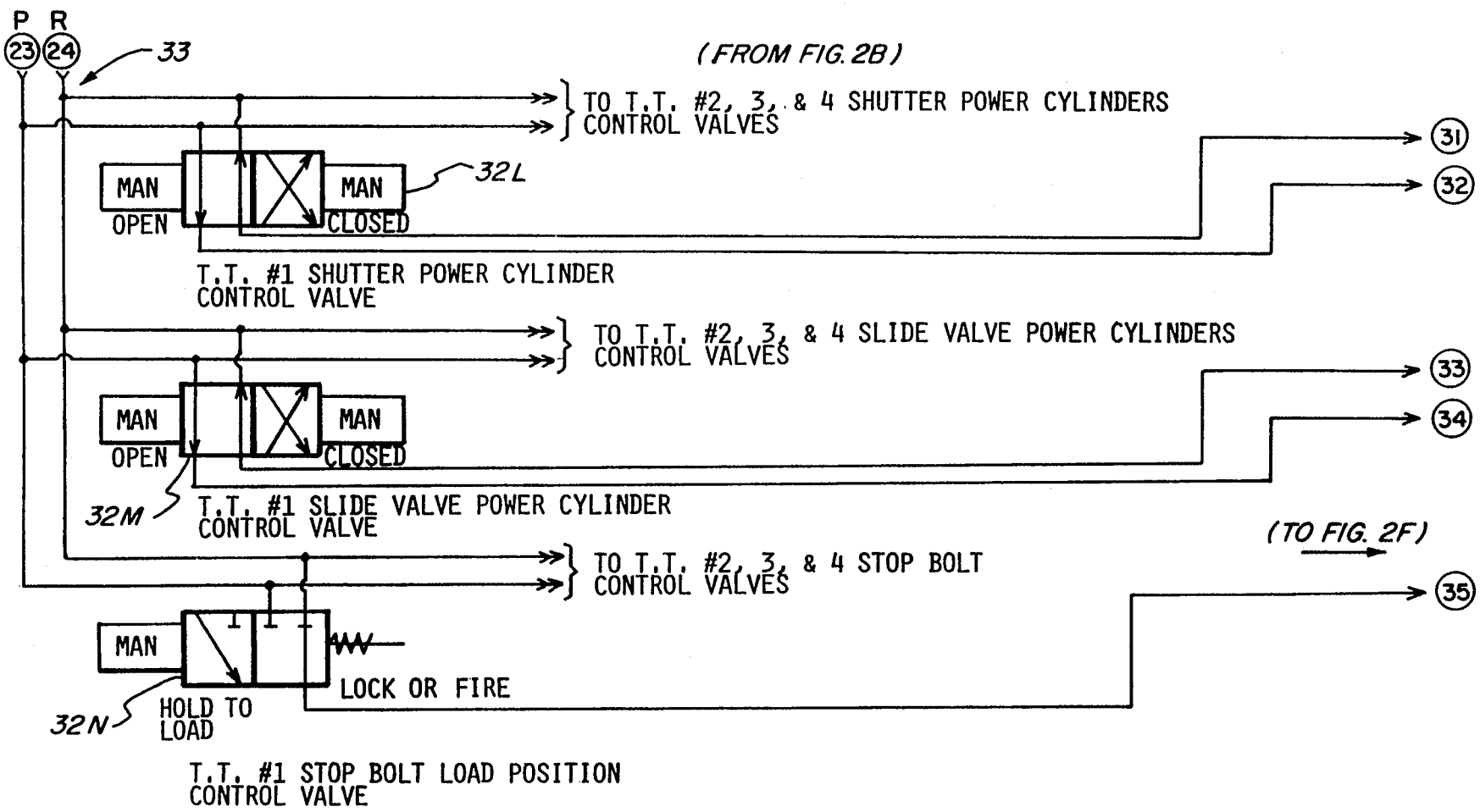

After a weapon has been loaded into a torpedo tube 40 (FIG. 3) from the torpedo room and the breech door 45 (FIG. 3) closed, the operator must ensure that the breech door locking ring switch **18*i* is in its leftward or "locked" position. This ensures that control valve 32*i* seen in FIG. 2B is in a position which actuates the breech door locking ring actuator valve 38*i* seen in FIG. 2E, which in turn operates the piston/cylinder 37*i* (FIG. 2E) to lock the ring (not shown) and prevents the breech door 45 (FIG. 3) from being opened. As shown in FIG. 2E, the piston/cylinder 37*i* is mechanically interlocked with the flood and drain cylinder 37F (FIG. 2D), the muzzle door cylinder 37K (FIG. 2E), and the slide valve cylinder 37M (FIG. 2F). It can be in the unlocked position only when the muzzle door power cylinder 37K (FIG. 2E) and the slide valve power cylinder 37M (FIG. 2F) are in their closed positions. Since the muzzle door 44 (FIG. 3 must be open prior to firing, the breech door 45** (FIG. 3) must be in the locked shut position.

When the muzzle door 44 (FIG. 3) is locked closed, the torpedo tube 40 (FIG. 3) can be flooded. The flood and drain valve slide switch 18F (FIG. 1) is moved to the open position which in turn causes control valve 32F (FIG. 2A) to operate the flood and drain actuator valve 38F (FIG. 2D) to move to its open position and operate the power/cylinder 37F (FIG. 2D). This will allow water to flow into the torpedo tube 40 (FIG. 3) once air can be vented from the torpedo tube. As can be seen in FIG. 2F, the flood and drain valve cylinder 37F is coupled to the interlock valve 70. This interlock valve prevents the ejection system from firing unless the torpedo tube flood and drain valve is in its closed position.

The vent valve slide switch 18H is opened to operate its control valve 32H (FIG. 2B) which causes the vent actuator valve 38H (FIG. 2E) to operate the power/cylinder 37H (FIG. 2E) and allow air to escape from the torpedo tube 40 (FIG. 3) as water flows thereinto. As can be seen from FIG. 2E, the power/cylinder 37H is connected to an interlock valve 72. This interlock valve prevents the ejection system from firing unless the torpedo tube vent actuator valve 38H is in its closed position.

A pressurized tank in the ship forces water through the drain valve into the torpedo tube 40 while air is vented from the tube. After an indicator (not shown) shows that the torpedo tube 40 (FIG. 3) is flooded, the flood and drain valve slide switch 18F (FIG. 1) is moved to its closed position, and the vent slide switch 18H (FIG. 1) is moved to its closed position. This in turn causes the actuator valves 38F (FIG. 2D), and 38H (FIG. 2E) to move the associated power/cylinders 37F (FIG. 2D, and 37H (FIG. 2E) to their closed position.

However, it will be physically impossible to overcome sea pressure on the torpedo tube muzzle door 44 unless pressure on both sides of the door are equalized. Therefore, the pressure equalization slide switch 18I (FIG. 1) is moved to its open position to open its control valve 32I (FIG. 2B) which opens the actuator valve 38I (FIG. 2E) to operate the power/cylinder 37I (FIG. 2E). This allows the pressure within the torpedo tube 40 to equalize with the pressure external to the hull. As seen, the power cylinder 37I (FIG. 2E) is not coupled to any interlock valve as the pressure equalize line size is so small that it poses no danger of excessive ship flooding.

At this point, the muzzle door slide switch 18K (FIG. I) is moved to its open position. This causes the muzzle door power cylinder control valve 32K (FIG. 2B) to move to its open position, and high pressure fluid opens the actuator valve 38K (FIG. 2E) causing the power/cylinder 37K (FIG. 2E) to open the muzzle door 44 (FIG. 3). As can be seen from FIG. 2E, the muzzle door power/cylinder 37K is interlocked with the interlock valve 76. The interlock valve 76 prevents the ejection system from firing unless the torpedo tube muzzle door 44 is completely open.

In the next step in the sequence, the shutter operating slide switch 18L (FIG. I) is moved to its open position which opens its control valve 32L (FIG. 2C) to open the shutter power cylinder actuator valve 38L (FIG. 2F) which actuates the power/cylinder 37L (FIG. 2F) to move the shutter door 46 (FIG. 3) into its open position. The power/cylinder 37L (FIG. 2F) is mechanically connected to the interlock valve 78 as shown in FIG. 2F, and this interlock valve 78 prevents the ejection system from firing unless the torpedo tube shutter 46 is completely open.

After the torpedo 42 (FIG. 3) had been loaded into the torpedo tube 40 (FIG. 3), the stop bolt slide switch 18M (FIG. 1) is moved to the lock/fire position either manually or by spring return. This positions control valve 32N (FIG. 2C) into a position which operates the actuator valve 38M (FIG. 2F) and the power/cylinder 37N (FIG. 2F) to move the lock bolt 47 (FIG. 3) into a position engaging the torpedo 42 (FIG. 3) to restrain it from axial movement within the torpedo tube 40 (FIG. 3) prior to firing the system.

As seen in FIG. 2F, a stop bolt blocked valve 80 cooperates with the control valve 38N to provide three positions for the stop bolt 47: "load", "lock" and "fire", the first limiting movement when a weapon is loaded into the tube 40 (FIG. 3), the second locking the torpedo 42 (FIG. 3) to prevent any motion in the tube, and the third disengaging the stop bolt. This third firing position of control valve 38N releases the weapon. Just prior to firing, the system mechanically positions the blocking valve 80 so that firing fluid will actuate the firing valve 68 if the swimout blocking valve 66 has not been actuated. Lastly, assuming that the torpedo is to be ejected from the torpedo tube, the slide valve slide switch 18M (FIG. 1) is moved to the open position to operate the control valve 32M (FIG. 2C) which opens the control valve 38M (FIG. 2F), and this operates the piston/cylinder 37M (FIG. 2F) to move the slide 49 (FIG. 3) to a position wherein the ports into the tube 40 (FIG. 3) are open to pressurized water driven by the air turbine 82 (FIG. 2F) which is powered by the flask 84 (FIG. 2F). As seen in FIG. 2F, the piston/cylinder 37M is connected to an interlock valve 64 which prevents the ejection system from firing unless the torpedo tube slide valve 3BM is in its fully open position.

When slide valve 38M is fully open, this will enable pressurized water to be introduced into the torpedo tube 40 aft of the torpedo 42 to develop sufficient pressure thereon to eject the torpedo 42 from the tube 40 at a relatively high speed. However, the system is so managed that firing fluid will not be available to the firing initiation control valve 32U unless the TEP door 38S is open and it will not travel to the firing valve 68 unless all the interlock valves are in their proper position.

At this point, the torpedo 42 (FIG. 3) is fully ready for firing and movement of the firing initiator slide switch 18U (FIG. 1) to the firing position allows pressurized fluid to flow through control valve 32U FIG. 2A) to the series of interlock valves 70 and 86 (seen in FIG. 2D), 72 and 76 (seen in FIG. 2B), and 78, 64 and 80 (seen in FIG. 2F), through the swimout blocking valve 66. This operates the firing valve 68 (FIG. 2F) causing pressurized air to drive the air turbine 82 which will pump water into the torpedo tube 40 (FIG. 3) and eject the torpedo 42 (FIG. 3). In order to effect this sequence, all slide switches 18F–N (FIG. 1) must be in their firing position (to the left) and all LED's will indicate that the switches are in the proper position for firing the system. This will be seen in FIG. 3.

Concurrently, the fire control system 43 (seen in FIG. 3) acts upon the torpedo 42 to provide necessary electrical signals to initiate weapon functions.

As seen in FIGS. 1, 2A and 2D, the system also includes a blow valve slide switch 18G (FIG. 1) which operates the control valve 32G (FIG. 2A) to open the actuator valve 38G (FIG. 2D) which operates the power cylinder 37G (FIG. 2D). An interlock valve 86 (FIG. 2D) is connected to the power cylinder 37G (FIG. 2D), and it prevents the ejection system from firing unless the torpedo tube blow valve 38G is in its fully closed position. The torpedo tube blow valve 38G is used in conjunction with the torpedo tube flood and brain valve 38F when it is desired to blow water out of the torpedo tube 40 prior to opening the torpedo tube breech door 45.

As will be appreciated, the hydraulic system of the present invention is relatively easy to control by use of the small pilot or control valves 32 behind the panel 10. These operate the large actuator valves 38 adjacent the power cylinders 37 which in turn operate the various elements of the torpedo tube assembly.

As can be seen, the system includes a series of interlocks to prevent firing if all elements are not in the proper position for firing. If the ejection pump door is not opened by the ejection pump control valve 32S and its actuator valve 38S, hydraulic power will not be provided to the firing initiator control valve 32U.

However, if the TEP door bypass control valve 32T is moved to the swimout position, hydraulic pressure actuates the swimout blocking valve 66 so the firing valve 68 will not open and it also actuates the slide valve bypass valve 62 which permits all slide valves to be closed during a swimout launch.

When the firing initiator control valve 32U is moved to the fire position, this ports hydraulic fluid through the subsequent interlock valves in the circuit.

If the flood and drain valve 38F is not in the closed position, flow will be blocked from the next valves in the circuit. The torpedo tube blow valve 38G must also be in the closed position; if it is not, flow will be blocked from the next valve in the circuit.

The torpedo tube vent valve 38H must be in the closed position; if it is not, flow will be blocked from the next valve in the sequence.

The torpedo tube pressure equalizing valve 37I can be either in the open or closed position. However, if it had not been opened and the tube 40 had not been pressure equalized, then the muzzle door 44 could not be opened. If the valve 37I remained open following firing of the torpedo, the amount of water which could potentially find its way into the torpedo room would pose no danger to the ship.

As seen, the breech door 45 is mechanically interlocked so that it can be opened only when the breech door locking ring power cylinder 37*i* is in the unlocked position. The breech door locking ring is also mechanically interlocked so that it can only be in the unlocked position when the muzzle door 44 and its power cylinder 37K and actuator valve 38K are in the closed and locked position. Because the muzzle door 44 must be open prior to firing, the breech door locking ring (and breech door) must be in the locked shut position.

The muzzle door 44 must be fully open to permit fluid to travel through its interlock valve 76. However, it should be noted that fluid cannot get to the muzzle door flow control valve 38K unless the flood and drain system valves 38F is first closed. It should also be noted that, when power is applied to open the muzzle door 44, it hydraulically locks the flood and drain valve 38F in the closed position. This prevents flooding through the muzzle door 44 and through the flood and drain valve of the torpedo tube 40.

If the shutter power cylinder 37L is not in the open position, fluid will be blocked from the next valve in the sequence.

If the slide valve power cylinder 37M is not in the open position, fluid will be blocked from the next valve in the sequence. As can be seen, the muzzle door 44 must be open before the slide valve 49 can open. As a result, this prevents opening the slide valve 49 unless the flood and drain valve power cylinder 37F is hydraulically locked closed. Without this arrangement, it would be possible to flood from the ejection pump door through the slide valve to the flood and drain system valves. Preferably, this connection in the circuit is made before the shutter interlock valve 78 to enable the shutter 46 to be closed for as long as is possible to minimize the ship's flow noise.

If the slide valve power cylinder 37M is open, fluid will be ported to the stop bolt control valve 38M to move the control valve from its normal lock position to is fire position. This releases the torpedo 42 for forward motion, and it moves the stop bolt blocking valve 80 to the open or fire position.

Fluid from the stop bolt blocking valve 80 is ported through the swimout blocking valve 66 and actuates the firing valve 68.

Following firing of the torpedo 42, either a rotational counter or a timer will return the firing initiator control valve 32U to its at-battery position, and this returns the stop bolt control valve 32M to its lock position and closes the firing valve 68.

However, if the salvo launch switch 30 is open and another tube 42 is flooded and pressure equalized with its muzzle door 44 and shutter 46 open, then this will close the first tube's slide valve 49 and open the slide valve 49 in the second tube 40 to fire the torpedo 42 in the second tube. The slide valves 49 of the bank of torpedo tubes 40 are interlocked so that only one can be open at a time After firing of the torpedo(s) 42, the several slide switches 18 are moved to the right hand or battery position. This closes the muzzle door 44 and blows the water out of the tube 40, and it enables the opening of the breech door 45 to load another torpedo 42 into the tube 40. In this process, the stop bolt 47 is in its load position to limit the movement of the torpedo 42 along the length of the tube 40.

Although various operational components of a preferred torpedo tube assembly have been illustrated and described, some of these components are optional and may be omitted.

Thus, it can be seen from the foregoing detailed specification and attached drawings that the torpedo launching and control assembly of the present invention may be readily assembled with small pilot valves at the control panel which are easily activated to control the actuator valves for the power cylinders in the actual torpedo tube assembly. Most of the valves are simple two position valves which are low cost and reliable. Moreover, a series of interlocked valves ensure that firing cannot be effected if all elements are not in proper position for firing.

In light of the above, it is therefore understood that within the scope of the appended claims, the invention may be practiced otherwise than as specifically described.

What is claimed is:

1. In a submarine, a torpedo launching and control assembly for launching a torpedo, comprising:

a multiplicity of torpedo tubes each having a muzzle door, a shutter and a breech door and having a series of fluid operated mechanisms which are movable from a first position to a second position for operation of various elements of the assembly and actuator valves for operating said mechanisms;

a source of fluid under pressure and conduits therefrom to said actuator valves for operating said fluid operated mechanisms; and a control panel having a series of manipulatable fluid control members each associated with one of said actuator valves for operating said fluid operated mechanisms, said control members being movable from a first position to a second position to effect the direction of flow of fluid to and from said actuator valves and thereby to move said mechanisms between said first and second positions, and visual indicators associated with said fluid control members to indicate the position of the associated fluid control member and thereby the fluid operated mechanism, and at least two interlock valves for interlocking at least two of said fluid operated mechanisms requiring fluid to flow through said interlock valves to permit operation of mechanisms subsequent thereto in the fluid path defined by said conduits if the interlocked mechanism effecting its actuation has not been moved to its second position.

2. The torpedo launching and control assembly in accordance with claim 1 wherein said fluid under pressure is hydraulic fluid.

3. The torpedo launching and control assembly in accordance with claim 1 wherein said visual indicators are illuminated and bear legends.

4. The torpedo launching and control assembly in accordance with claim 1 wherein interlocking valves are provided requiring said shutter and muzzle door mechanisms to have been moved to its second position to effect firing of the torpedo.

5. The torpedo launching and control assembly in accordance with claim 1 wherein at least some of said fluid operated mechanisms include a piston/cylinder component and said piston effects the desired movement of an operating element of the assembly and said actuator valves control the flow of fluid thereto.

6. The torpedo launching and control assembly in accordance with claim 2 wherein said some of said fluid operated mechanisms include said breech and muzzle doors.

7. The torpedo launching and control assembly in accordance with claim 1 wherein said control members comprise a pilot valve and a manipulatable switch on the face of said panel for operating said pilot valve to control flow therethrough.

8. The torpedo launching and control assembly in accordance with claim 5 wherein said switch is a slide switch.

9. The torpedo launching and control assembly in accordance with claim 1 wherein said control members for each torpedo tube are aligned in a column and are movable horizontally from their first position to said second position.

10. The torpedo launching and control assembly in accordance with claim 9 wherein said first and second positions of said control members are vertically aligned.

11. The torpedo launching and control assembly in accordance with claim 10 wherein the corresponding control members for said multiplicity of torpedo tubes are disposed in aligned rows in a multiplicity of columns.

12. The torpedo launching and control assembly in accordance with claim 1 wherein said mechanisms include:

a firing actuator control valve;

a valve for flooding said torpedo tube;

a valve for equalizing pressure in the flooded tube with the pressure external to the submarine;

means for opening said muzzle door;

means for opening said shutter; and means for firing the torpedo.

13. The torpedo launching and control assembly in accordance with claim 12 wherein there is included among said fluid operated mechanisms a vent valve for venting air form said tube during flooding.

14. The torpedo launching and control assembly in accordance with claim 12 wherein there are included in said fluid operated mechanisms an ejection pump door and a ejection pump door bypass for swimout of the torpedo.

15. The torpedo launching and control assembly in accordance with claim 12 wherein there is included an actuator for moving the fluid control member associated with said firing initiator control valve from the second position to the first position upon firing of the torpedo.

16. The torpedo launching and control assembly in accordance with claim 15 wherein there is included a salvo switch which is operative to prevent said actuator from moving said firing initiator control value to enable firing of torpedoes in said multiplicity of torpedo tubes as a salvo.

17. The torpedo launching and control assembly in accordance with claim 16 wherein there is included within said fluid operated mechanisms a slide valve functioning to provide pressure against the aft end of the torpedo to discharge it from the torpedo tube and a solenoid to open said valve upon receipt of a signal that the torpedo has been discharged, said slide valves of the several torpedo tubes being interlocked to permit sequential firing when said salvo switch is actuated.

* * * * *